US011029043B2

(12) United States Patent
Whittington

(10) Patent No.: US 11,029,043 B2
(45) Date of Patent: Jun. 8, 2021

(54) COMPACT FAN AND AIR CONDITIONER ASSEMBLY

(71) Applicant: Peter Whittington, Oakland Park, FL (US)

(72) Inventor: Peter Whittington, Oakland Park, FL (US)

( * ) Notice: Subject to any disclaimer, the term of this patent is extended or adjusted under 35 U.S.C. 154(b) by 0 days.

(21) Appl. No.: 16/460,328

(22) Filed: Jul. 2, 2019

(65) Prior Publication Data

US 2020/0109865 A1 Apr. 9, 2020

Related U.S. Application Data

(63) Continuation-in-part of application No. 16/150,692, filed on Oct. 3, 2018, now Pat. No. 10,823,181.

(51) Int. Cl.

| | |
|---|---|
| ***F24F 1/0029*** | (2019.01) |
| ***F24F 1/0047*** | (2019.01) |
| ***F04D 25/08*** | (2006.01) |
| ***F04D 29/38*** | (2006.01) |
| ***F04D 29/58*** | (2006.01) |

(52) U.S. Cl.

CPC ..... *F24F 1/0029* (2013.01); *F04D 25/088* (2013.01); *F04D 29/388* (2013.01); *F04D 29/582* (2013.01); *F24F 1/0047* (2019.02); *F24F 2221/14* (2013.01); *F24F 2221/18* (2013.01)

(58) Field of Classification Search

CPC .... F24F 1/0029; F24F 1/0047; F24F 2221/14; F24F 2221/18; F04D 25/088; F04D 29/388; F04D 29/582

See application file for complete search history.

(56) References Cited

U.S. PATENT DOCUMENTS

| | | | | |
|---|---|---|---|---|
| 4,586,349 A | | 5/1986 | Ohishi | |
| 5,029,451 A | | 7/1991 | Imaiida et al. | |
| 5,524,450 A | * | 6/1996 | Chen | F24F 1/0003 62/259.1 |

(Continued)

FOREIGN PATENT DOCUMENTS

| | | | | |
|---|---|---|---|---|
| CN | 206160344 U | | 5/2017 | |
| DE | 202016105308 U1 | * | 10/2016 | F24F 3/1603 |
| WO | 2014156542 A1 | | 2/2017 | |

*Primary Examiner* — Marc E Norman

(74) *Attorney, Agent, or Firm* — Laurence A. Greenberg; Werner H. Stemer; Ralph E. Locher

(57) ABSTRACT

A compact fan and air conditioner assembly includes an air conditioner mounted stationary below a ceiling of a room. The air conditioner produces a quantity of cold air. A fan receives the cold air from the air conditioner. The fan has a housing mounted stationary below the air conditioner and blades rotating about the housing. The fan blades have channels receiving the cold air from the air conditioner and slots formed in the blades for receiving the cold air from the channels and distributing the cold air into the environment as the fan blades rotate. A split fan and air conditioner assembly includes a floor stand on which the air conditioner and the fan are mounted. A split fan and air conditioner assembly having a ceiling fan unit separate from a compressor unit and a portable air conditioner assembly having a rotatable head unit, are also provided.

4 Claims, 16 Drawing Sheets

(56) References Cited

U.S. PATENT DOCUMENTS

| | | | | |
|---|---|---|---|---|
| 6,587,642 | B1 * | 7/2003 | King | F04D 25/088 392/364 |
| 7,367,201 | B1 | 5/2008 | Doring et al. | |
| D741,469 | S | 10/2015 | Pan | |
| 9,683,752 | B2 | 6/2017 | Edwards et al. | |
| 2003/0228142 | A1 | 12/2003 | Reiker | |
| 2004/0149869 | A1 | 8/2004 | Chen | |
| 2007/0155304 | A1 | 7/2007 | Hyun et al. | |
| 2019/0056128 | A1 * | 2/2019 | Jacob | B01D 46/0027 |
| 2019/0242392 | A1 * | 8/2019 | Whitmire | F04D 29/34 |
| 2019/0277514 | A1 * | 9/2019 | Roy | F04D 19/002 |

* cited by examiner

COMPACT FAN AND AIR CONDITIONER ASSEMBLY

CROSS-REFERENCE TO RELATED APPLICATION

This application is a Continuation-In-Part of co-pending U.S. application Ser. No. 16/150,692, filed Oct. 3, 2018; the prior application is herewith incorporated by reference in its entirety.

BACKGROUND OF THE INVENTION

Field of the Invention

The invention relates to a compact fan and air conditioner assembly which enhances the cooling effect of a fan.

Description of the Related Art

U.S. Publication No. 2003/0228142 discloses a ceiling mounted heating and cooling device in which an air conditioning system is installed above a ceiling in an attic of a room and a fan is disposed below the ceiling and receives cold air from the air conditioning system. The device requires an attic and the installation of equipment in the attic. A portion of the cold air may be directed away from the fan blades.

U.S. Pat. No. 6,587,642 similarly provides an air conditioner condenser unit mounted above or beyond a ceiling of a room and an evaporator unit mounted inside or at the ceiling. The evaporator unit draws in hot room air, cools the air and blows the air toward a conventional, separate ceiling fan. A portion of the cold air may therefore be directed away from the fan blades.

U.S. Pat. No. 7,367,201 relates to an air conditioning fan in which an air conditioning unit, a fan having fan blades with evaporator tubing within the blades and a motor are all suspended from a ceiling of a room. The motor rotates the entire conditioning unit and the fan blades together. The fan blades are cooled by the evaporating moisture and the air in the room is impacted by the cooled fan blades. The motor must be large enough to rotate the relatively heavy air conditioning unit and the tubing within the fan blades does not carry cold air.

The prior art devices either mount all or part of the air conditioning unit at or above a ceiling or rotate the entire air conditioning unit with the fan blades. The prior art devices also do not supply all of the cold air from the air conditioning unit to the fan blades in manner which prevents leakage of cold air.

BRIEF SUMMARY OF THE INVENTION

It is accordingly an object of the invention to provide a compact fan and air conditioner assembly, which overcomes the hereinafore-mentioned disadvantages of the heretofore-known devices of this general type and which requires no installation above a ceiling, rotates only the fan blades and directs all of the cold air to and through the fan blades.

With the foregoing and other objects in view there is provided, in accordance with the invention, a compact fan and air conditioner assembly as a first embodiment, comprising an air conditioner configured to be mounted in a stationary manner below a ceiling of a room. The air conditioner produces a quantity of cold air, and a fan receives all of the quantity of cold air from the air conditioner. The fan has a housing configured to be mounted in a stationary manner below the air conditioner, and the fan has fan blades configured to rotate about the housing. The fan blades have channels receiving the cold air from the air conditioner, and the fan blades have slots formed therein for receiving the cold air from the channels and distributing the cold air into the environment in a room as the fan blades rotate.

The assembly according to the invention requires no installation above a ceiling, only the fan blades and not the air conditioner rotate and all of the cold air is directed to and through the fan blades so that no leakage reducing the cooling effect takes place.

In accordance with another feature of the invention, the air conditioner includes an evaporator coil, a blower fan blowing cold air through the evaporator coil, and an air ventilator chamber receiving the cold air from the evaporator coil and guiding the cold air into the channels in the fan blades. The channels in the blades therefore receive the cold, air conditioned air which would otherwise be directed to vents in a standard prior art air conditioner.

In accordance with another feature of the invention, the fan blades have ends, and each of the ends has two respective circular lobes having some of the slots formed therein for emitting the cold air to be circulated by the fan. It has been found that the use of multiple vents in circular lobes aids in the circulation of the cold air throughout the room.

In accordance with another feature of the invention, the blades each have a respective angled end for enhancing circulation of the cold air. The angled ends add more turbulence to the air in the room which in turn spreads the cold air in the room.

In accordance with another feature of the invention, the air conditioner includes condenser, a vent attached to the housing, and a blower fan blowing hot air through the condenser and out of the housing into the vent. The hot air is thus carried away from the space to be cooled, for instance to the outside of a building.

In accordance with another feature of the invention, the air conditioner includes a water pump for removing condensate from the housing. This feature ensures that no water will drip from the assembly.

With the objects of the invention in view, there is also provided a split fan and air conditioner assembly as a second embodiment, comprising a floor stand, an air conditioner mounted on the floor stand, the air conditioner producing a quantity of cold air, and a fan mounted on the floor stand. The fan receives all of the quantity of cold air from the air conditioner. The fan has a housing and the fan has fan blades configured to rotate about the housing. The fan blades have channels receiving the cold air from the air conditioner, and the fan blades have slots formed therein for receiving the cold air from the channels and distributing the cold air into the environment in a room as the fan blades rotate.

In accordance with another feature of the invention, the floor stand includes a base and a telescoping pole mounted on the base. The height of the assembly can therefore be adjusted, in a manner similar to a fan standing on a base.

In accordance with another feature of the invention, a vent line receives hot air from the air conditioner. Thus, in this embodiment as well, the hot air is carried away from the space to be cooled, for instance to the outside of a building.

In accordance with another feature of the invention, a cold air line guiding the cold air from the air conditioner to the fan. Due to the cold air line, the fan can be placed at a distance from the air conditioner which is limited only by the length of the line.

In accordance with a further feature of the invention, the air conditioner has a housing with an access door. In this way, a pan collecting condensate water can be emptied or a filter can be changed.

With the objects of the invention in view, there is additionally provided a split fan and air conditioner assembly as a third embodiment, comprising a compressor unit and a ceiling fan unit being separate from the compressor unit and being configured to be mounted in a stationary manner below a ceiling of a room. The ceiling fan unit includes an evaporator core communicating with the compressor unit in an air conditioning circuit for producing a quantity of cold air, and the ceiling fan unit has a hub and fan blades configured to rotate about the hub. The fan blades having channels receiving the quantity of cold air and the fan blades having vents communicating with the channels for distributing the quantity of cold into the environment as the fan blades rotate.

In accordance with another feature of the invention, the ceiling fan unit includes an impeller connected to the fan blades, a motor, an upper shaft interconnecting the motor and the impeller and permitting the motor to rotate the fan blades, a shaft enclosure and a lower shaft disposed in the shaft enclosure below the upper shaft, the lower shaft being connected to the hub and spinning freely.

In accordance with a further feature of the invention, the ceiling fan unit includes an inlet for receiving ambient air, evaporator tubing and evaporator fins disposed in the evaporator core and permitting refrigerant to be fed through the evaporator core, and a filter cover being removable for cleaning the evaporator fins.

In accordance with an added feature of the invention, the fan blades are angled downward allowing air to fall and distribute cooled air, and the vents are circular permitting ambient air to be pulled over a 300-degree surface at an upper most part of the ceiling fan unit.

In accordance with an additional feature of the invention, the hub is an air distribution chamber, and the ceiling fan unit includes a lower enclosure covering the hub and a resilient barrier with bristles preventing cool air from escaping from the hub.

The air conditioner fan of the third embodiment also includes wireless Bluetooth speakers as well as the latest in wireless and smart technology supporting remote control and automation from WiFi, Bluetooth, Zigby and Zwave compatible smart hubs, which may be controlled at a control display panel. The control display panel contains a controller or microprocessor which may be programmed by a user to operate the air conditioner during certain time periods and at certain temperature settings and to rotate the head unit so as to oscillate through settable angles, as well as to play music or other programs available on the Internet or on separate devices, such a smart phones.

With the objects of the invention in view, there is furthermore provided a portable air conditioner as a fourth embodiment assembly, comprising a movable floor stand and a self-contained, upright air conditioner unit mounted on the floor stand and producing a quantity of cold air. The air conditioner unit includes a housing containing an evaporator core, a compressor and a condenser in an air conditioning circuit for producing the quantity of cold air. The housing contains an evaporator core fan associated with the evaporator core for pulling ambient air through the evaporator core and a hot air exhaust having an exhaust fan for cooling the condenser. The air conditioner unit includes a rotatable head unit disposed above the housing, the head unit having an ambient air intake, an intake fan communicating with the ambient air intake and at least vertically movable vents releasing cool air from the evaporator core fan mixed with ambient air from the intake fan. In this way, the mixed cooled and ambient air may be forced over a distance of at least 20 feet, for cooling particularly large areas.

In accordance with another feature of the invention, the housing contains a programmable motor for turning the head unit so as to emit cooled air from the vents in different directions.

In accordance with a further feature of the invention, the exhaust fan is a turbine exhaust fan, a vent is disposed at a base of the housing downstream of the turbine exhaust fan, and an air filter is disposed in the housing upstream of the turbine exhaust fan.

In accordance with an added feature of the invention, the housing contains a condensate collecting tray at a base of the housing to be emptied occasionally as needed.

In accordance with a concomitant feature of the invention, the housing contains a control display panel for controlling operation of the air conditioner unit and rotation of the head unit through a selectable angular motion, such as 360 degrees.

The fourth embodiment is a portable, high velocity, air conditioner system which takes the traditional practice of placing the fan in front of an air conditioner unit and delivers an all in one device which provides a greater projected cooled air distribution in a contemporary layout. The fourth embodiment of the portable, high-velocity air conditioner system is projected to perform well in situations where cooled air is required to be distributed over distances in excess of 20 feet or more.

Other features which are considered as characteristic for the invention are set forth in the appended claims.

Although the invention is illustrated and described herein as embodied in a compact fan and air conditioner assembly, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DETAILED DESCRIPTION OF THE INVENTION

Figure 1:
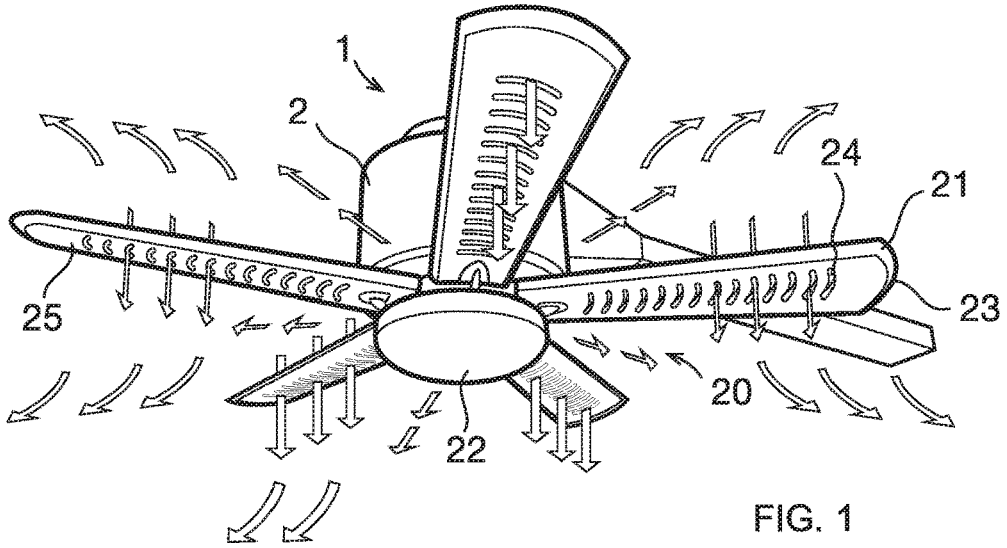
FIG. 1 is a diagrammatic, perspective view of a first embodiment of the compact fan and air conditioner assembly according to the invention having planar fan blades.
Figure 2:
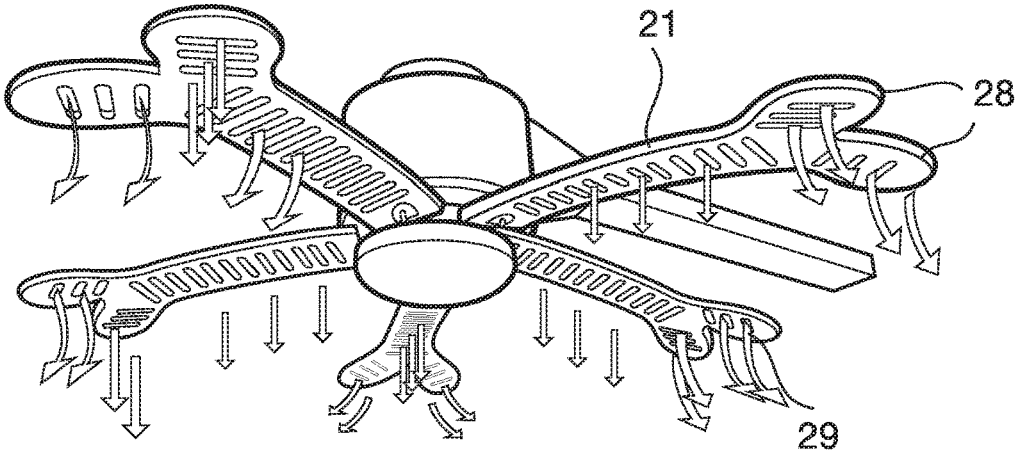
FIG. 2 is a perspective view of the first embodiment of the assembly having lobes on the ends of the fan blades.
Figure 3:
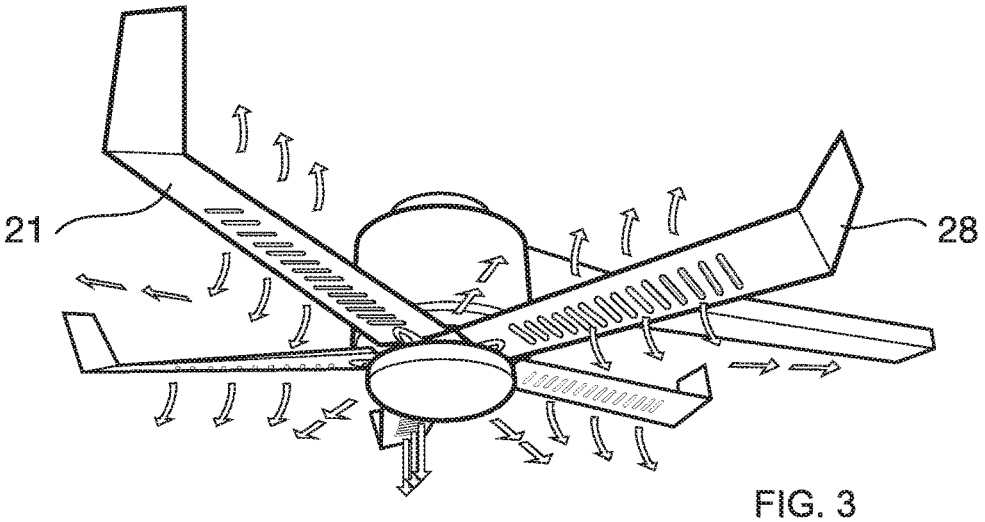
FIG. 3 is a perspective view of the first embodiment of the assembly having angled ends of the fan blades.

Referring now to the figures of the drawing in detail and first, particularly, to FIG. 1 thereof, there is seen an assembly in which an air conditioner 1 is disposed above a fan 20. The air conditioner 1 has a housing 2 containing components of the air conditioner, which are described in detail below. The air conditioner 1 blows cold air downwards into fan blades 21 of the fan 20. A light 22 is fastened below a hub connected to the fan blades. The fan blades 21 have curved ends 23 and internal channels 26 (see FIG. 4) which conduct the cold air through elongated slots 24 in the lower surfaces 25 of the blades. The cold air is circulated by the movement of the blades in the direction of the arrows. FIG. 2 shows that the ends 23 of the blades 21 each have two circular lobes 28 which also have slots 29 for emitting the cold air to be circulated by the fan. The blades may each alternatively have one or more than two lobes. According to FIG. 3, the blades 21 each have an angled end 28 which adds to the circulation of the cold air.

Figure 4:
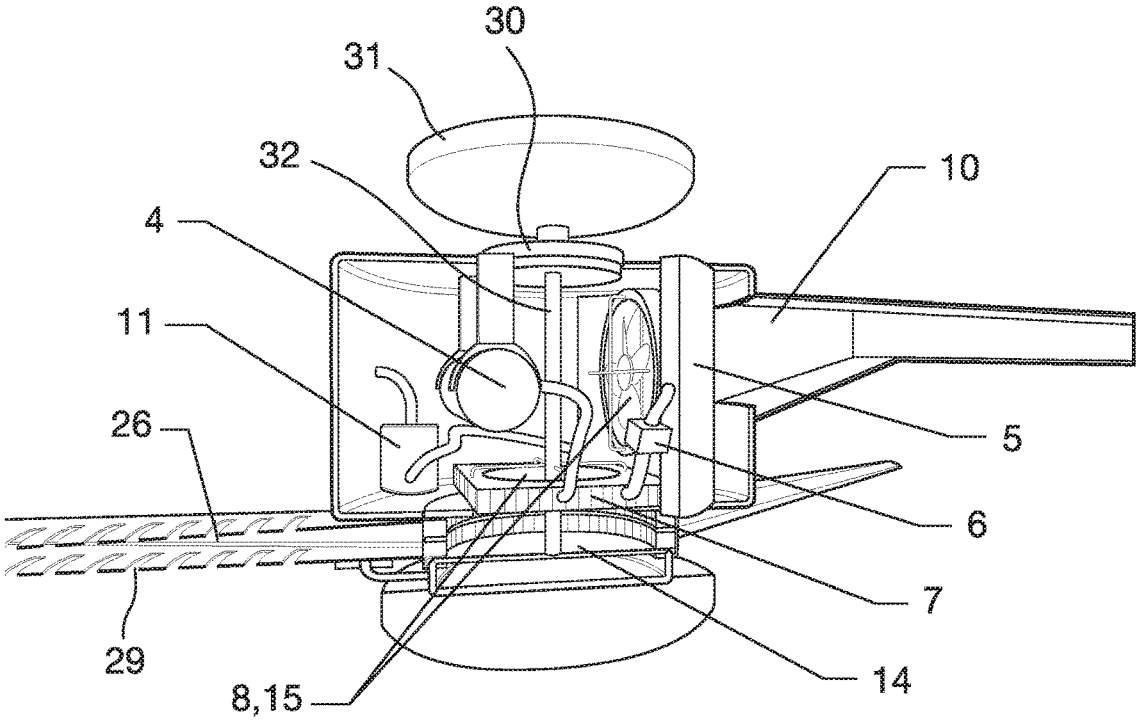
FIG. 4 is an enlarged, fragmentary view of the body of the fan showing internal details.
Figure 5:
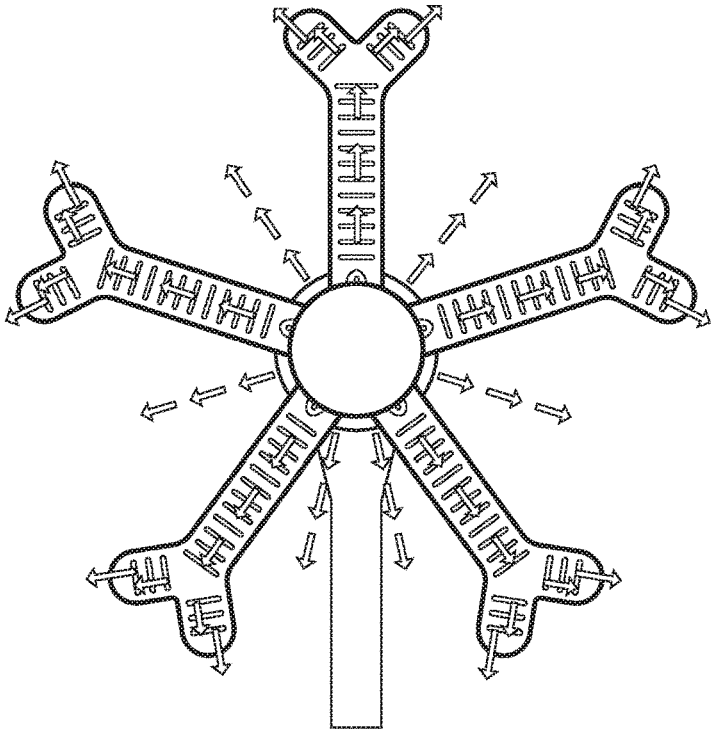
FIG. 5 is a bottom-plan view of the assembly of FIG. 2.

The housing 2 of the air conditioner 1 shown in FIG. 4 contains a compressor 4, a condenser 5, an expansion valve 6 and a evaporator coil 7 in an air conditioning circuit. A first blower fan 8 blows hot air through the condenser 5 and out of the housing 2 into a vent 10. A water pump 11 pumps condensate out of the housing 2. A second blower fan 15 blows cold air through the evaporator coil into an air ventilator chamber 14 which guides the cold air into channels 26 in the fan blades 21 leading to the slots 29. The cold air can also be guided through the air ventilator chamber 14 and the channels 26 without the use of the blower fan 15 due to the differential pressure created by the rotating blades. In this regard, FIG. 5 shows the assembly of FIG. 2 from below in order to indicate the movement of the cold air along the arrows. A fan motor 30 is supported on a ceiling by a bracket disposed within a cover 31. The fan motor 30 drives the fan blades 21 through a shaft 32. The connection between the shaft and the blades is not illustrated for the sake of clarity.

Figure 6:
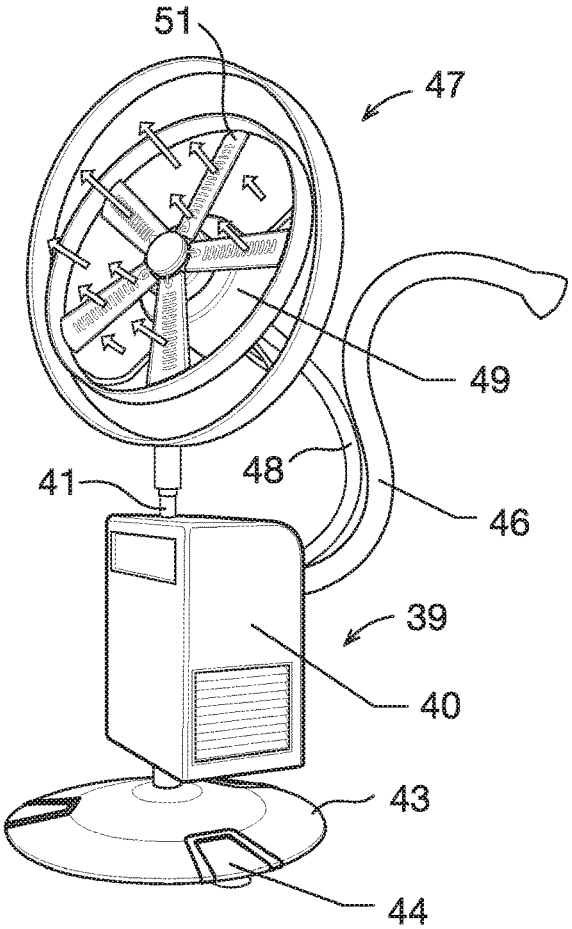
FIG. 6 is a front-perspective view of a second embodiment of the assembly constructed as a split system.
Figure 7:
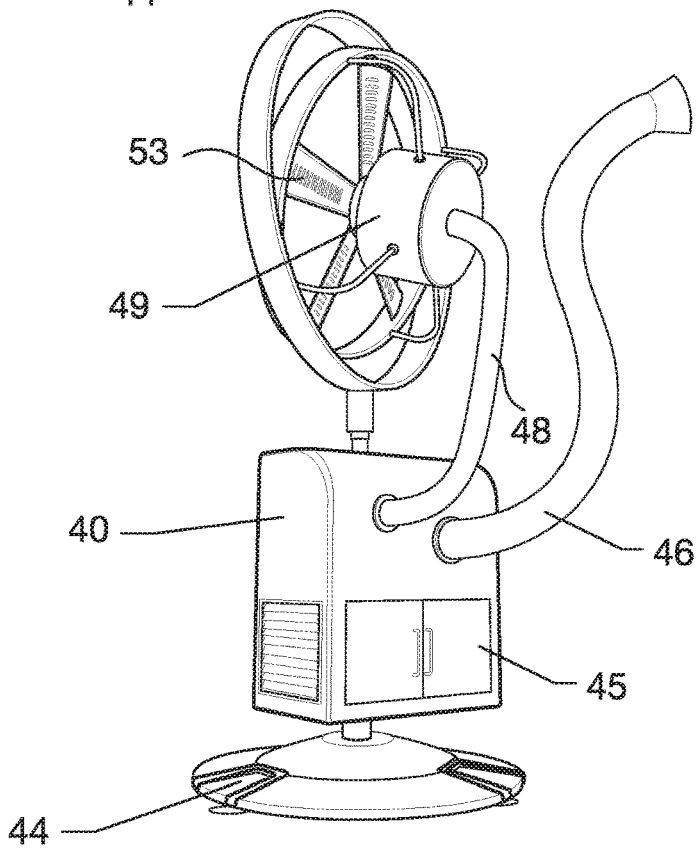
FIG. 7 is a rear-perspective view of the second embodiment of the assembly shown in FIG. 6.

The second embodiment of the assembly shown in FIGS. 6 and 7 is a split system in which an air conditioner 39 has a housing 40 containing a compressor, a condenser, an expansion valve and a evaporator coil in an air conditioning circuit, as well as two blowers, as is shown in FIG. 4. The housing 40 is supported by a telescoping pole 41 mounted on a base 43 having suction activated pedals 44 for gripping the floor. The telescoping pole 41 and the base 43 together may be referred to as a floor stand. A rear door 45 provides access to a non-illustrated tray for receiving condensate and to a non-illustrated filter.

A vent line 46 receives hot air blown through the condenser from the first blower fan. A cold air line 48 receives cold air blown by the second blower through the evaporator coil. The cold air line 48 leads to a fan 47 having a fan housing 49 containing a motor for turning fan blades 51 and an air ventilation chamber guiding the cold air from the cold air line 48 to the fan blades. The fan blades have channels receiving the cold air from the cold air line 48 and guiding the cold air to slots 53 in the fan blades which emit the cold air in the direction of the arrows. The fan blades may have the lobes of FIG. 2 or the angled ends of FIG. 3.

Figure 8:
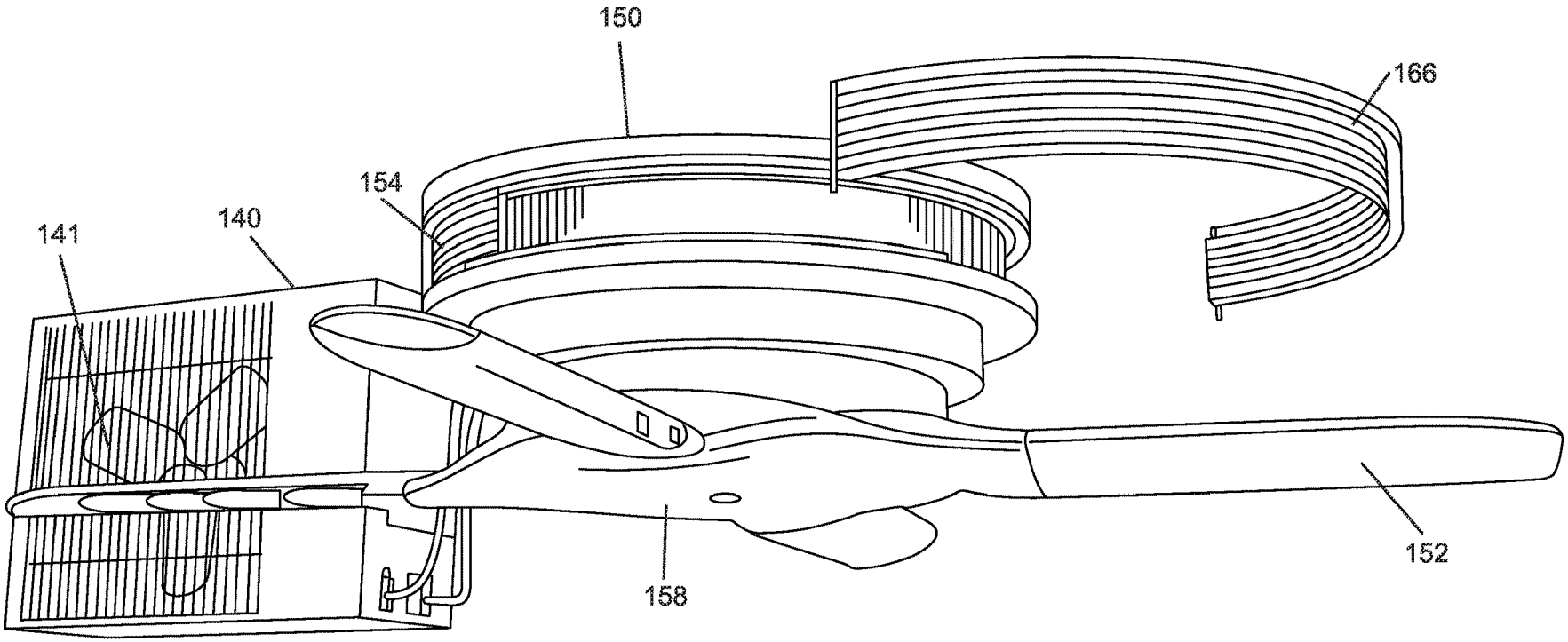
FIG. 8 is a perspective view of a third embodiment of the assembly constructed as a split system fan and air conditioner assembly.

FIG. 8 is a perspective view of the third embodiment of the compact fan and air conditioner assembly which is constructed as a cross between a conventional ceiling mounted fan and a mini spilt air conditioning unit. The system includes a ceiling fan unit 150 and a compressor unit 140. The compressor unit 140 has a housing which contains a fan 141, a non-illustrated compressor, a condenser and an expansion valve in an air conditioning circuit with a coil 157 of evaporator tubing in the ceiling fan unit 150, as will be explained below.

Figure 9:
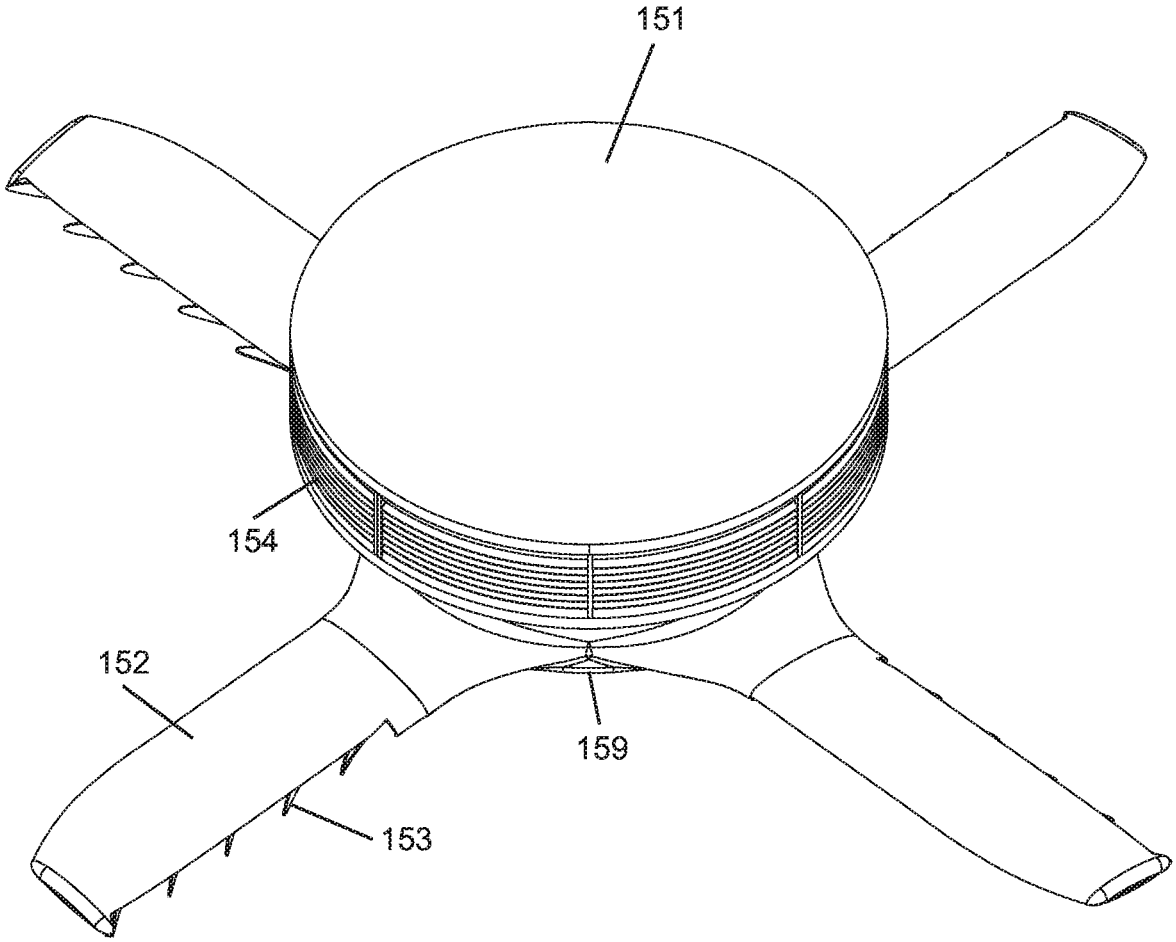
FIG. 9 is a perspective view of the fan of the third embodiment.
Figure 10:
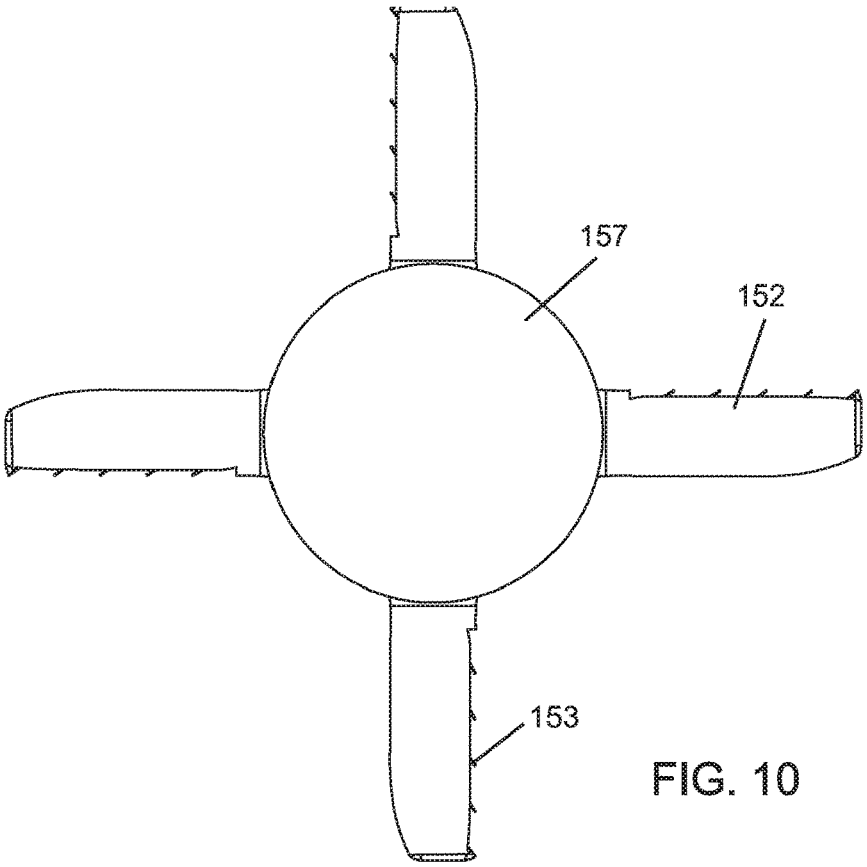
FIGS. 10 and 11 are respective top-plan and bottom-plan views of the fan of the third embodiment.
Figure 11:
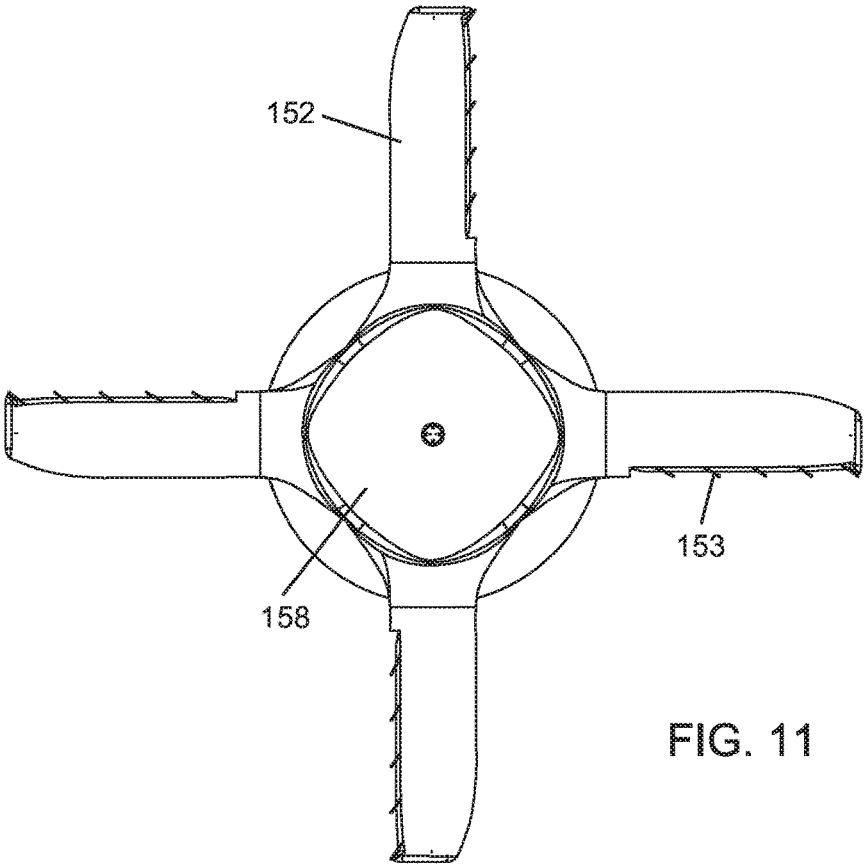
Figure 12:
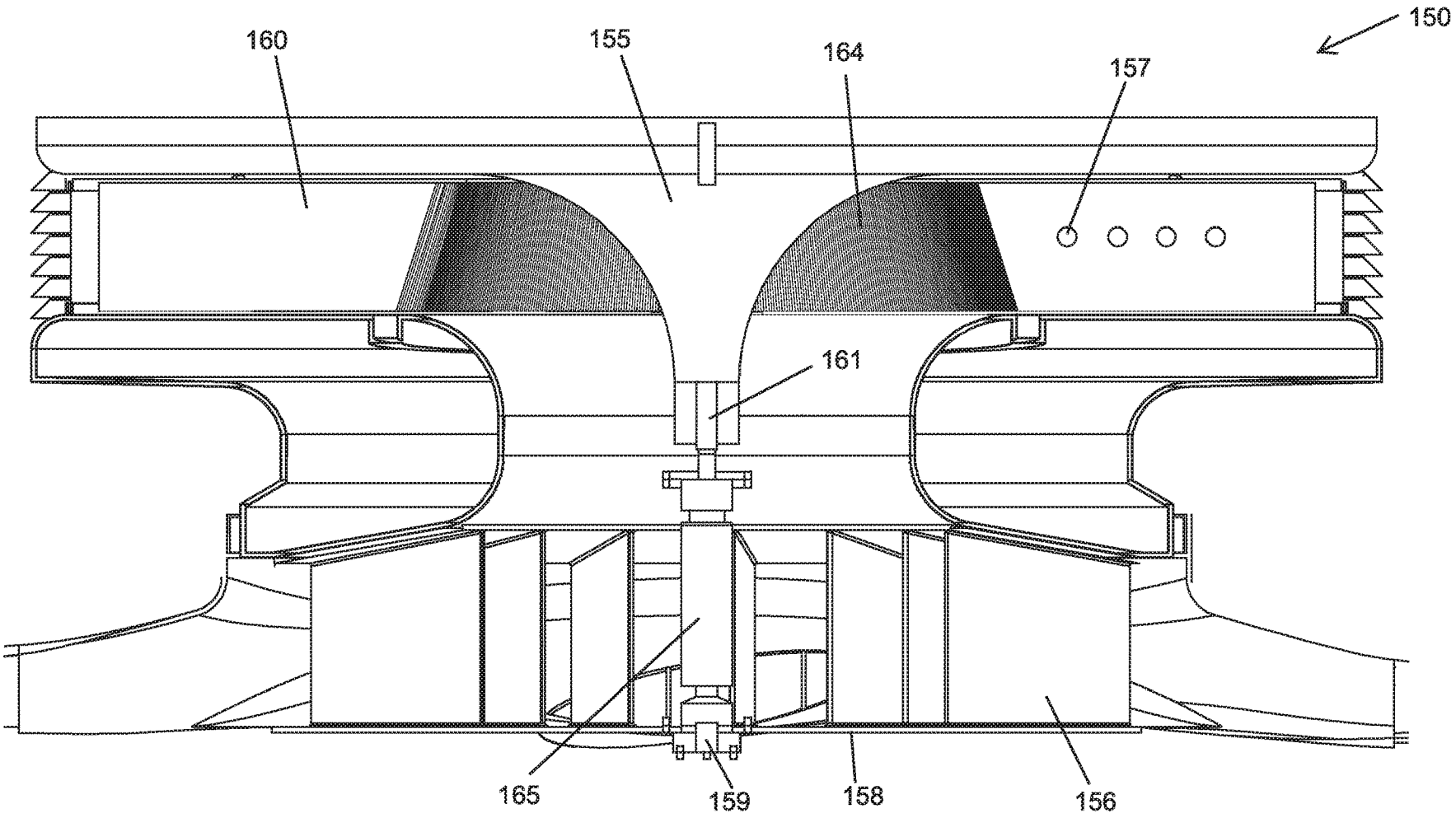
FIG. 12 is a longitudinal-sectional view of the fan of the third embodiment.
Figure 15:
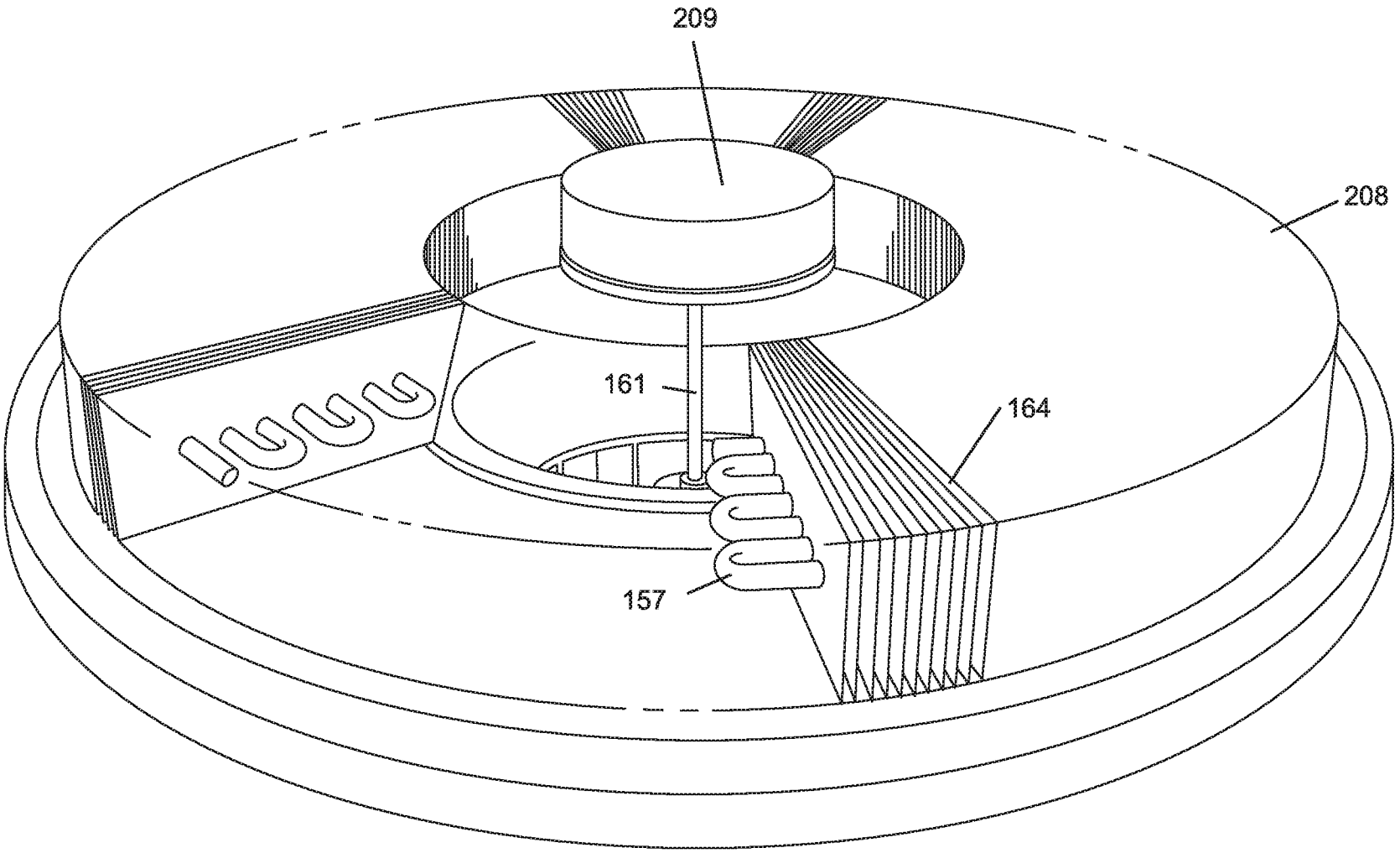
FIG. 15 is a perspective view of the fan of the third embodiment with the cover removed to show the coils.
Figure 16:
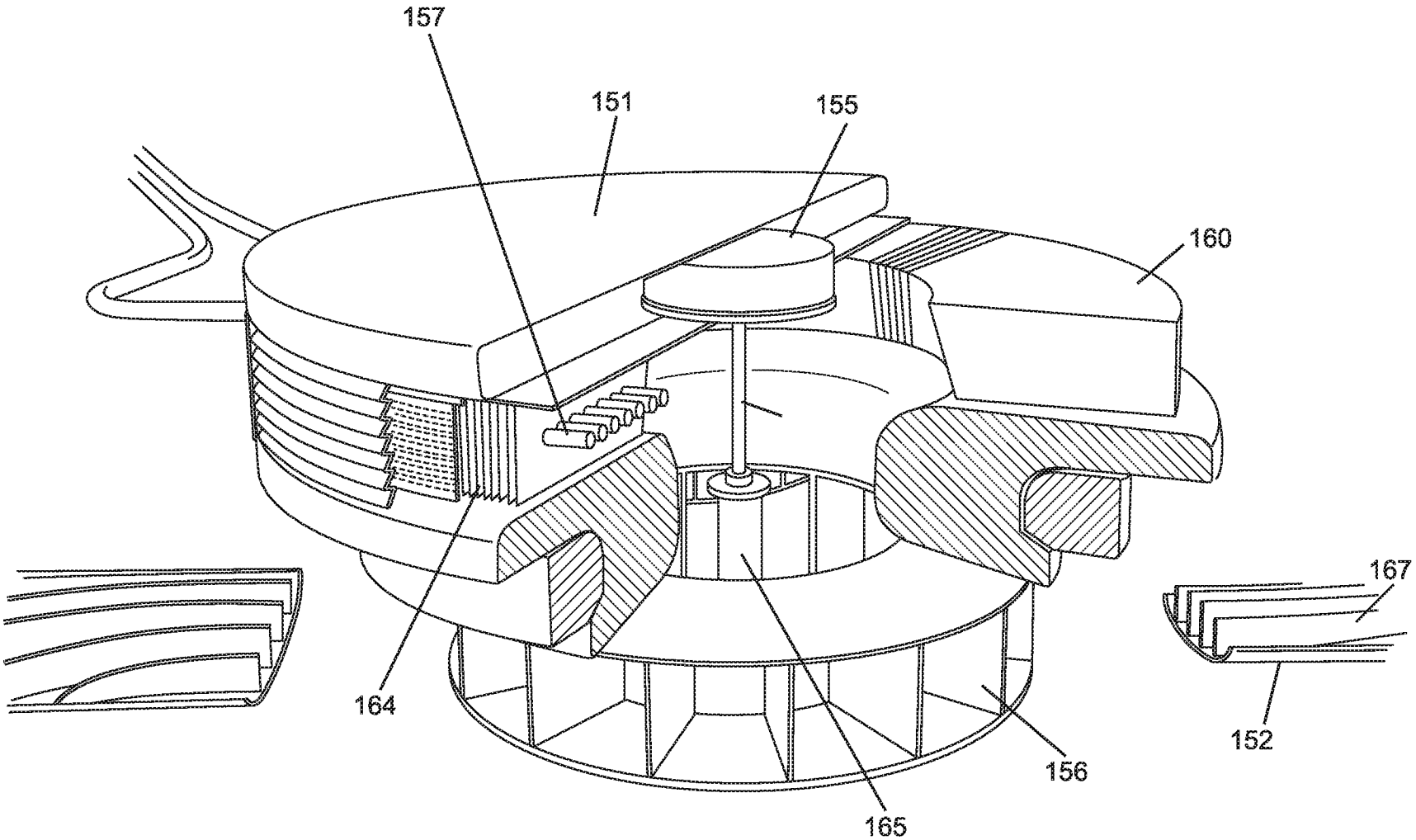
FIG. 16 is another partly broken-away, perspective view of the fan of the third embodiment.
Figure 17:
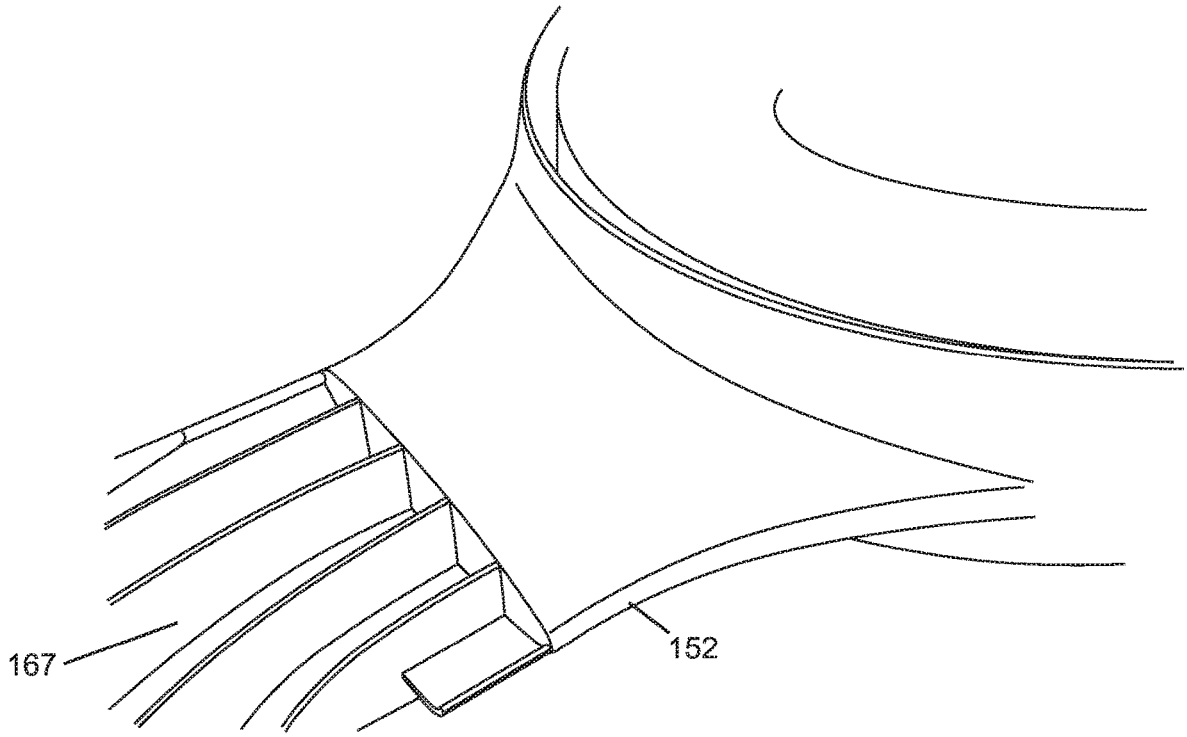
FIG. 17 is an enlarged, fragmentary, perspective view of the fan of the third embodiment.

The ceiling fan unit 150 is an air handler which includes an upper enclosure 151 shown in FIGS. 9 and 10, three or four fan blades 152 having vents 153 for releasing cool air as shown in FIGS. 9-11, an inlet 154 for receiving ambient air and a lower enclosure 158 covering a ceiling fan hub 159. The fan blades are angled downward allowing air to fall and providing an excellent distribution of cooled air. Since the shape of the vents is circular, ambient air is pulled over a 300-degree surface located on the upper most part of the fan. FIG. 12 shows that the fan unit 150 includes a motor 155 for driving an impeller 156 which is also seen in FIG. 16. The fan unit 150 also includes copper evaporator tubing 157 in an evaporator core 160 having evaporator fins 164, as is best seen in FIGS. 12, 15 and 16. Refrigerant is fed through the evaporator core from the air conditioner condenser. A filter cover 166, which is removable for cleaning the evaporator fins 164, is also shown in FIG. 8. A light may be fastened below the lower enclosure 158.

Figure 13:
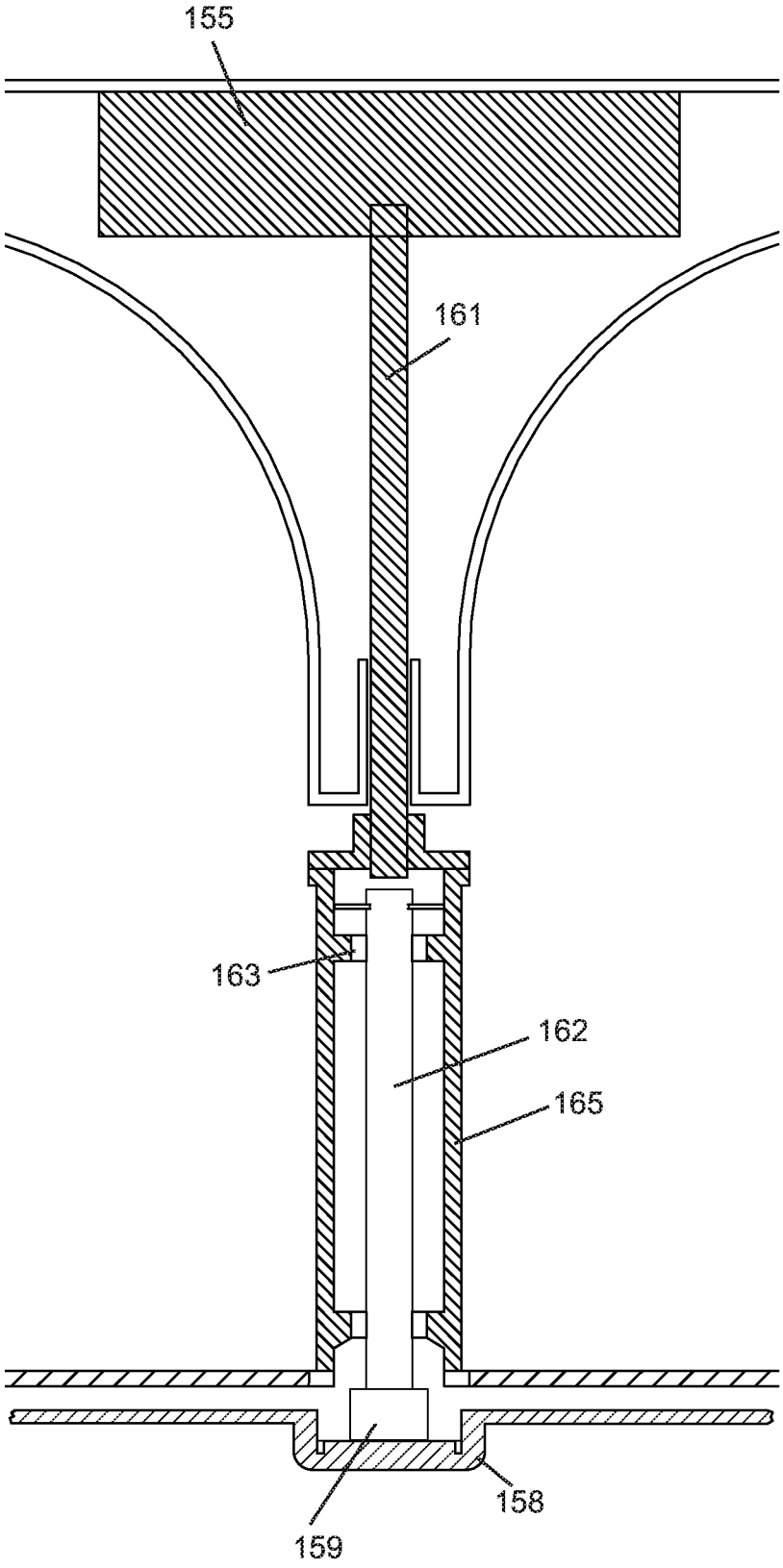
FIG. 13 is a fragmentary, longitudinal-sectional view of a drive of the fan of the third embodiment.
Figure 14:
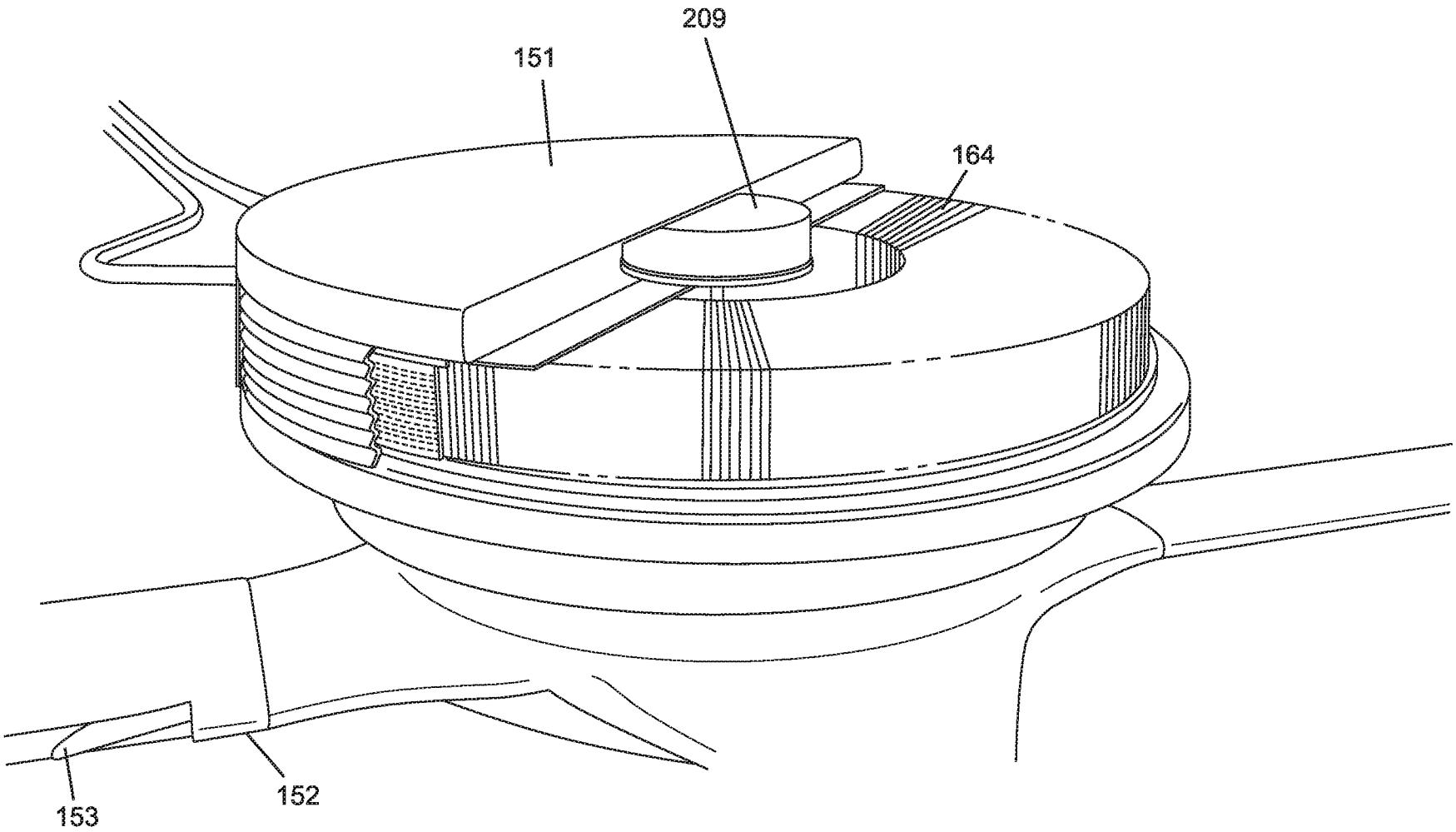
FIG. 14 is a partly broken-away, perspective view of the fan of the third embodiment.
Figure 18:
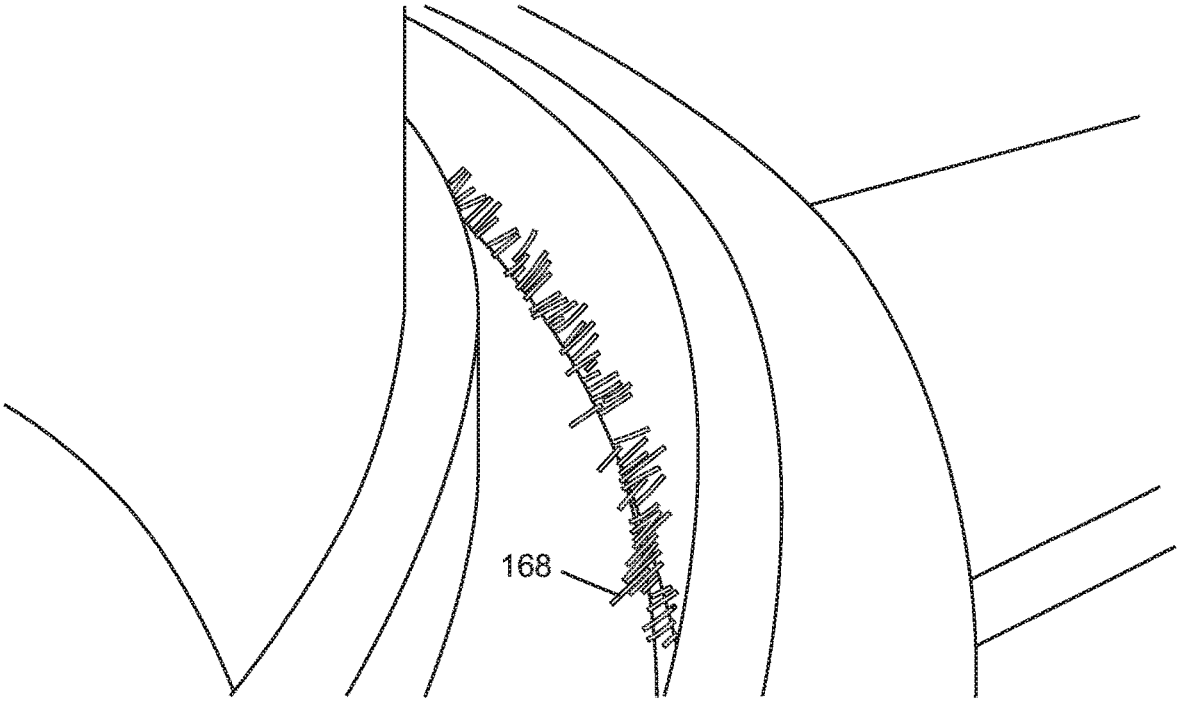
FIG. 18 is a further enlarged, fragmentary, perspective view of the fan hub of the third embodiment.

FIG. 13 shows that the impeller motor 155 drives an upper shaft 161, which in turn only drives the impeller 156 and thus the fan blades 152. A lower shaft 162 in an inner lower shaft enclosure 165 is connected only to the fan hub 159 and spins freely on bearings 163, so that the lower shaft 162 is not connected to the motor 155. A resilient of rubber brush-like barrier with bristles 168 shown in FIG. 18 prevents cool air from escaping from the fan hub 159, which is used as an air distribution chamber.

The operation of the third embodiment is similar to that of the first embodiment, in that cold air is blown outwards through elongated slots 167 enclosed within the blades 152 which lead to the vents 153. The cold air is circulated by the movement of the blades.

As ambient air passes over the surface of the fins in the evaporator core it loses heat allowing cooled air to pass down into the fan hub for distribution into the fins. The flat high velocity motor drives the impellor within the fan hub. This creates negative pressure and that is how the air gets pulled in. This is a similar configuration used traditionally in conventional vacuum cleaners. Cool air from the evaporator core is thrust from the impellor and through the fan blades. The centrifugal motion of the impeller plus the thrusting out of air through the curved blades within the fins creates the turning motion driving the rotation of the fan blades providing optimal air distribution.

Figure 19:
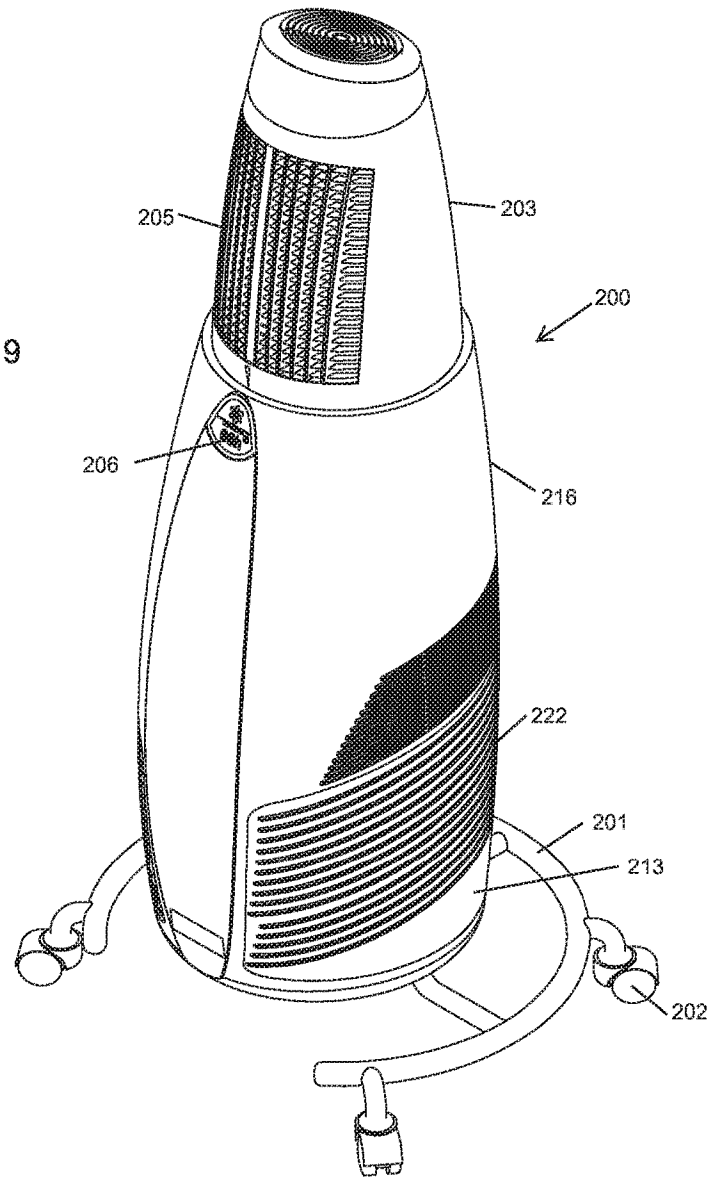
FIG. 19 is a perspective view of a fourth embodiment of the assembly constructed as a self-contained, upright unit movable on casters.
Figure 20:
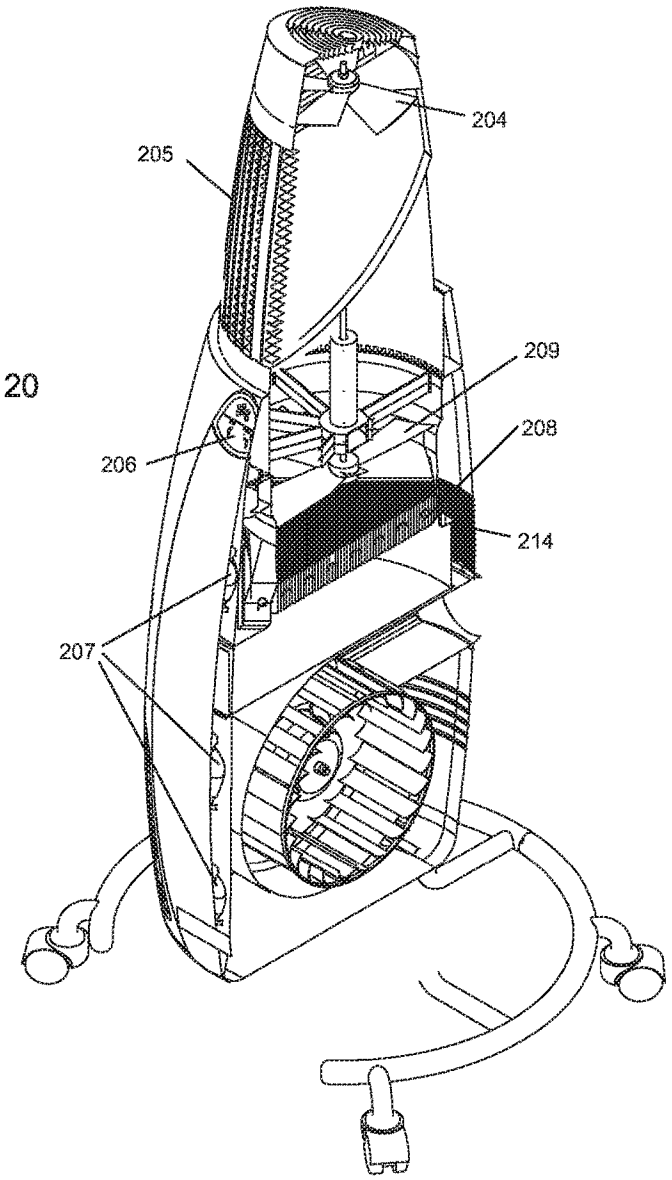
FIG. 20 is a longitudinal-sectional view of the fourth embodiment.
Figure 22:
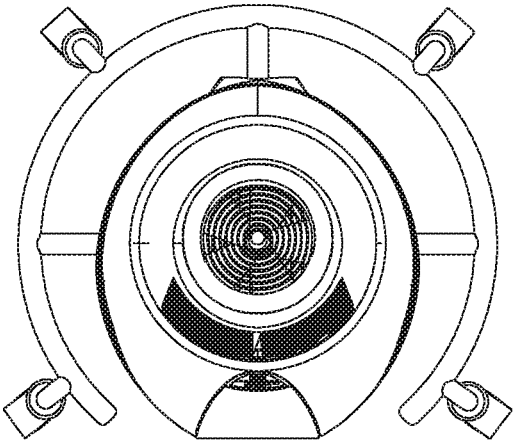
FIG. 22 is a top-plan view of the fourth embodiment.
Figure 21:
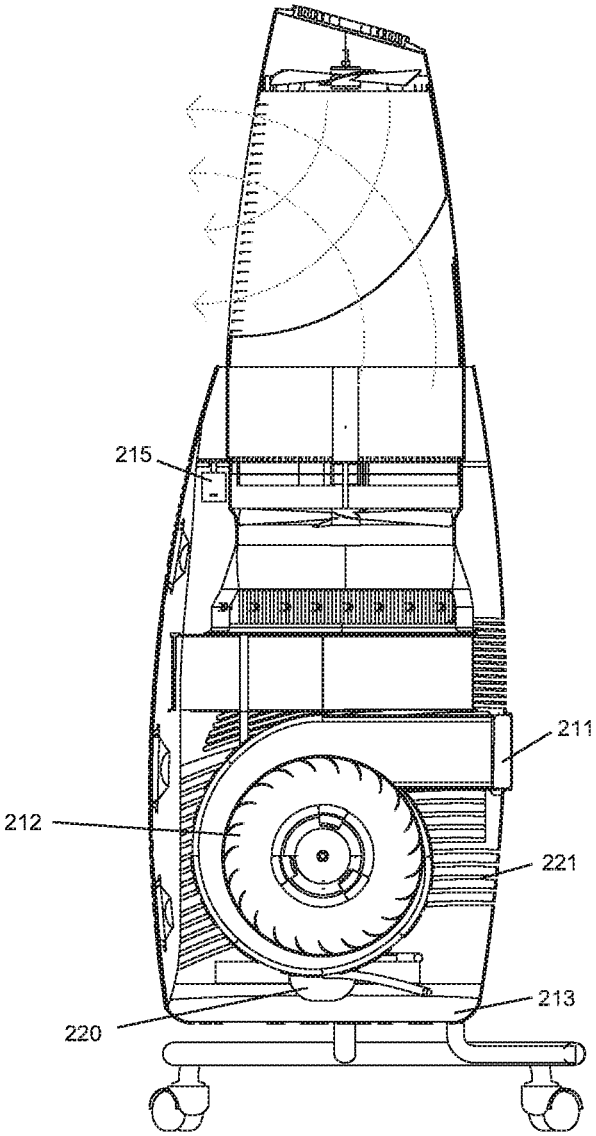
FIG. 21 is another longitudinal-sectional view of the fourth embodiment.
Figure 25:
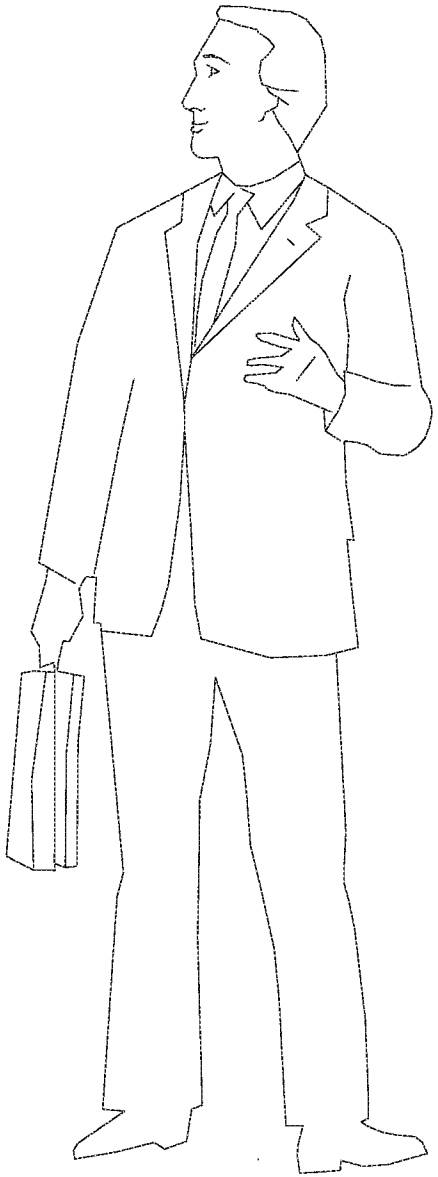
FIG. 25 is an illustration indicating the size of the fourth embodiment relative to a person.
Figure 24:
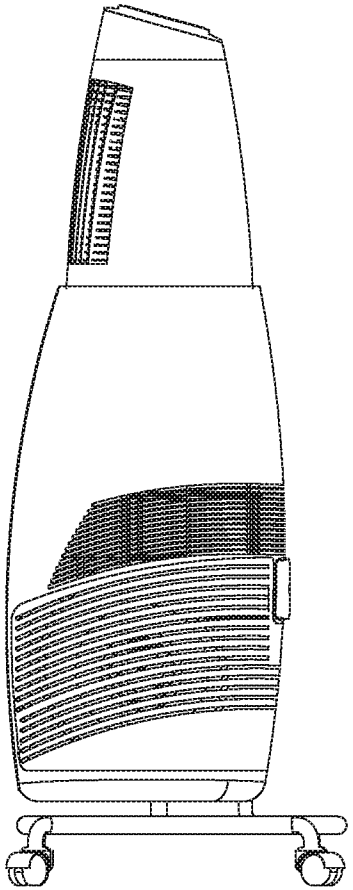
FIGS. 23 and 24 are respective front-elevational and side-elevational views of the fourth embodiment.
Figure 23:
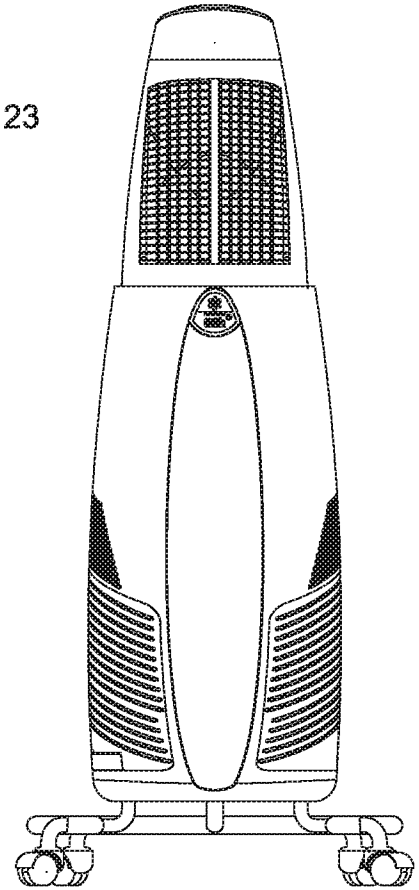

The fourth embodiment of the compact fan and air conditioner assembly, which is shown in a perspective view FIG. 19, is constructed as a self-contained, upright unit 200 movable on a stand 201 having lockable wheels or casters 202. As is seen in FIG. 20, a rotatable head unit 203, which turns through 360 degrees, contains an ambient air intake 204 with an intake fan 210 and adjustable vents 205 releasing cool air. A housing 216 below the head 203 contains a control display panel 206, fully wireless-capable speakers 207 having smart connectivity, an evaporator core 208 having an evaporator core fan 209, a hot air exhaust 211 having a turbine exhaust fan 212, a condensate collecting tray 213 and an air filter 214. A programmable motor 215 is provided for turning the head so as to emit cooled air from the vent 205 in different directions as indicated by the arrows in FIG. 21. Complete 360-degree motion is accomplished by the programmable motor which is located just below the head unit 203.

A compressor 220 and a curved condenser 221 located behind a vent 222 at the base of the unit are connected in an air conditioning circuit including an expansion valve and an evaporator coil.

The condenser 221 is cooled by using the turbine fan 212 and hot air exhaust is fed through a non-illustrated heat flex tube which is connected to the hot air exhaust 211 and vented to the outdoors. Cooled air is created from pulling ambient air through the evaporator core 208 via the fan 209 in the center of the unit. The compressor 220 is located adjacent the turbine fan 212 so that condensate from the evaporator core 208 is collected by a pipe and fed into the condensate collecting tray 213 at the base of the unit and can be emptied occasionally as needed.

Cooled air passes into the head unit 203 and out through the adjustable vents 205. The head unit 203 features three unique capabilities of the present invention. The vents 205 in the head unit 203 output air from two sources, that is cooled air from the evaporator core 208 and ambient air from the upper high velocity fan 204. Air from these two sources is combined together to provide twice the velocity of cooled air being distributed from the unit, so as to force air over distances in excess of 20 feet or more. The vents 205 each have ducts which can direct air vertically up or down.

The combined housing and head of the fourth embodiment stands approximately 4.5 feet tall and is 18 inches wide at its widest circumference.

The invention claimed is:

1. A split fan and air conditioner assembly, comprising:

a compressor unit; and a ceiling fan unit being separate from said compressor unit and being configured to be mounted in a stationary manner below a ceiling of a room, said ceiling fan unit including an evaporator core communicating with said compressor unit in an air conditioning circuit for producing a quantity of cold air, and said ceiling fan unit having a hub being an air distribution chamber and fan blades configured to rotate about said hub;

said ceiling fan unit including a lower enclosure covering said hub and a resilient barrier with bristles preventing cool air from escaping from said hub;

said fan blades having channels receiving said quantity of cold air and said fan blades having vents communicating with said channels for distributing said quantity of cold into the environment as said fan blades rotate.

2. The assembly according to claim 1, wherein said ceiling fan unit includes an impeller connected to said fan blades, a motor, an upper shaft interconnecting said motor and said impeller and permitting said motor to rotate said fan blades, a shaft enclosure and a lower shaft disposed in said shaft enclosure below said upper shaft, said lower shaft being connected to said hub and spinning freely.

3. The assembly according to claim 1, wherein said ceiling fan unit includes an inlet for receiving ambient air, evaporator tubing and evaporator fins disposed in said evaporator core and permitting refrigerant to be fed through said evaporator core, and a filter cover being removable for cleaning said evaporator fins.

4. The assembly according to claim 1, wherein said fan blades are angled downward allowing air to fall and distribute cooled air.

* * * * *